United States Patent [19]

Johnson

[11] Patent Number: 4,518,120

[45] Date of Patent: May 21, 1985

[54] NON-FOULING OIL ATOMIZATION TIP

[75] Inventor: Gregory L. Johnson, Houston, Tex.

[73] Assignee: Shell Oil Company, Houston, Tex.

[21] Appl. No.: 610,931

[22] Filed: May 16, 1984

Related U.S. Application Data

[63] Continuation of Ser. No. 409,374, Aug. 18, 1982, abandoned.

[51] Int. Cl.[3] ..... B05B 7/06

[52] U.S. Cl. ..... 239/424; 239/549

[58] Field of Search ..... 239/290, 296, 398, 416.4, 239/416.5, 423, 424, 424.5, 425, 429, 430, 434.5, 548, 549

[56] References Cited

U.S. PATENT DOCUMENTS

| | | | |
|---|---|---|---|
| 2,933,259 | 4/1960 | Raskin | 239/549 |
| 3,204,682 | 9/1965 | Teleshefsky et al. | 239/424.5 |
| 3,215,351 | 11/1965 | Briggs | 239/424 |
| 3,313,535 | 4/1967 | Hopkins | 239/398 |
| 3,556,497 | 1/1971 | Grenfell | 239/548 |

FOREIGN PATENT DOCUMENTS

| | | | |
|---|---|---|---|
| 1460927 | 10/1966 | France | 239/424 |
| 256889 | 1/1928 | Italy | 239/424 |
| 802701 | 10/1981 | USSR. | |

*Primary Examiner*—Andres Kashnikow
*Assistant Examiner*—James R. Moon, Jr.

[57] ABSTRACT

The present invention pertains to an oil atomizer suitable for use with a heavy liquid fuel which is constituted by a cylindrical body for delivery of the heavy liquid fuel to an atomization zone, spray tubes in the atomization zone arranged about the periphery of a conical cap terminating the cylindrical barrel and a shroud surrounding the cylindrical barrel and permitting passage therebetween and a shroud tip terminating the shroud and enclosing the cap, the spray tubes being inserted through openings in the shroud tip which permit passage of air or other fluid around the spray tubes.

3 Claims, 2 Drawing Figures

NON-FOULING OIL ATOMIZATION TIP

This is a continuation of application Ser. No. 409,374, filed Aug. 18, 1982 now abandoned.

BACKGROUND OF THE INVENTION

There are five types of fuel oil burners in use at the present time, namely steam atomizing, high pressure air atomizing, low pressure air atomizing, spray nozzle or mechanical atomizing, and rotary mechanical atomizing. The selection of the proper type of burner involves many factors, some of which are of purely local significance. Thus, if very heavy oil is to be burned under boilers upon which the load varies greatly, the mechanical spray burner is at a serious disadvantage and the tendency of steam jet burners to "go out" with low fires must be considered. If medium or light gravity oil is to be used and the load is steady, either mechanical burners or steam burners will operate satisfactorily. The use of high pressure air burners is becoming obsolete for boiler plants but they are still used to advantage in some types of metallurgical furnaces.

The present invention is most particularly concerned with high pressure steam or other gaseous fluid atomizing burners. Burners of this type require fluid supply at pressures from 50 to 500 pounds per square inch. Such burners may require atomization fluid flow equal to up to 50 or 60 percent of the fuel flow mass rate. When this type of burner is used with a heavy liquid fuel such as pitch, there may be a problem with coke deposits on the tips of the burner. The deposits may interfere with the spray pattern and may eventually cause the burner to completely choke off. Accordingly, the present invention is directed to solving this and other problems as will be apparent from the following disclosure thereof.

Applicant is not aware of any prior art references which, in his judgment as one skilled in the burner art, would anticipate or render obvious the novel oil atomizer of the instant invention.

SUMMARY OF THE INVENTION

The present invention provides an oil atomizer suitable for use with a heavy liquid fuel which includes the following components: an elongated barrel for delivery of the heavy liquid fuel to an atomization zone; spray tubes in the atomization zone arranged about the periphery of a cap terminating the elongated barrel; a shroud surrounding the elongated barrel and permitting passage of air or other fluid therebetween; and a shroud tip terminating the shroud and enclosing the cap, the spray tubes being inserted through openings in the shroud tip which permit passage of air around the spray tubes. Preferably, the spray tubes extend through the shroud a distance about equal to the outside diameter of the spray tubes and the openings in the shroud have a width which is about 1.5 times the outside diameter of the spray tubes.

DESCRIPTION OF PREFERRED EMBODIMENTS

The oil atomization tip of the present invention prevents coke deposits from growing on the spray tubes of an oil atomizer when heavy liquid fuels such as pitch are fired. Purge fluid is supplied surrounding the spray tube at about 0.5 to 10 percent of total combustion air or more preferably, 1 to 2 percent of total combustion air. Fluid velocity around the spray tubes is maintained at about 15 to 250 feet per second or more preferably, 50 to 150 feet per second. Purge fluid is preferably heated, from about 200° to 600° F. The separated shroud operates at high temperatures of 800° to 1600° F. to increase burn-off rate of accumulated coke on the shroud. By this technique, the present design effectively reduces the oil droplet deposition rate on the spray tubes of the burner.

Figure 1:
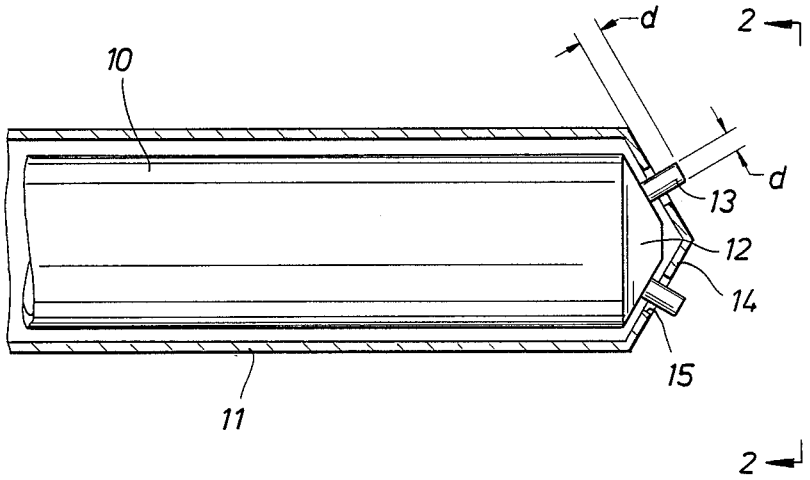
FIG. 1 discloses a cross sectional view of the oil atomizer of the present invention.
Figure 2:
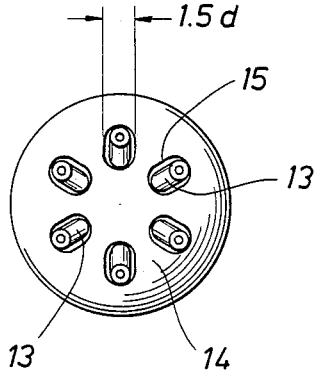
FIG. 2 provides an end view of the oil atomizer of FIG. 1.

Referring to the drawings, as shown in FIG. 1, the elongated or preferably cylindrical barrel 10 of the twin fluid atomization gun is surrounded by a shroud 11 which provides an annular gap for purge air about the barrel 10. The barrel 10 is terminated by a cap 12, preferably conical, to which are attached shroud tubes 13 which extend through a shroud tip 14 at the end of shroud 11 and having openings 15 through which the spray tubes 13 are inserted. As shown in FIG. 2 openings or slots 15 in the cap 14 have a width which is about 1.2 to 3 times, or preferably one and one-half times, the outside of the spray tubes 13. The spray tubes 13 extend through the openings 15 a distance of about equal to or about 1 to 3 times the outside diameter of the spray tubes. Shroud tip 14 preferably is made from a high temperature alloy, for example Hastealloy X (nickel, iron, chromium, molybdenum alloy manufactured by Cabot Corporation) or Inconel 600 (nickel, iron, chromium alloy manufactured by Huntington Alloys).

The foregoing description of the invention is merely intended to be explanatory thereof. Various changes in the details of the described atomizer may be made within the scope of the appended claims without departing from the spirit of the invention.

What is claimed is:

1. An oil atomizer suitable for use with a heavy liquid fuel comprising:

an elongated barrel for delivery of the heavy liquid fuel to an atomization zone;

spray tubes in the atomization zone arranged about the periphery of a cap terminating the elongated barrel;

a separated shroud surrounding the elongated barrel and operable at temperatures of 800° to 1600° F. to burn off coke accumulating thereon, the shroud and barrel permitting passage of fluid therebetween; and a shroud tip terminating the shroud and enclosing the cap, the spray tubes being inserted through openings in the shroud tip a distance about 1 to 3 times the outside diameter of the spray tubes, the openings being about 1.2 to 3 times the outside diameter of the spray tubes, which permit passage of fluid around the spray tubes.

2. The oil atomizer of claim 1 wherein the elongated barrel is cylindrical and the cap is conical.

3. The oil atomizer of claim 1 wherein the shroud tip is of a high temperature alloy.

* * * * *